US006280372B1

(12) United States Patent
Focke et al.

(10) Patent No.: US 6,280,372 B1
(45) Date of Patent: Aug. 28, 2001

(54) PROCESS AND APPARATUS FOR PREPARING PACKAGING MATERIAL FOR THE PRODUCTION OF (CIGARETTE) PACKS

(75) Inventors: Heinz Focke, Verden; Hans-Jürgen Bretthauer, Bremen, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/417,751

(22) Filed: Oct. 14, 1999

(30) Foreign Application Priority Data

Oct. 16, 1998 (DE) ..... 198 47 893

(51) Int. Cl.[7] ..... B31B 1/26; B31B 1/50

(52) U.S. Cl. ..... 493/8; 493/20; 493/248; 493/436; 493/455; 493/476; 493/910

(58) Field of Search ..... 493/8, 13, 14, 493/17, 18, 19, 20, 248, 436, 438, 439, 440, 455, 456, 476, 911, 910

(56) References Cited

U.S. PATENT DOCUMENTS

| | | | | |
|---|---|---|---|---|
| 3,646,415 | | 4/1972 | Hook | 93/13 |
| 3,868,892 | * | 3/1975 | Winnemoller | 93/8 |
| 4,016,808 | | 4/1977 | Young | 493/261 |
| 4,508,218 | | 4/1985 | Focke et al. | 206/271 |
| 5,151,073 | * | 9/1992 | Focke | 493/79 |
| 5,292,301 | * | 3/1994 | Focke | 493/356 |
| 5,762,186 | | 6/1998 | Focke et al. | 206/245 |
| 5,820,540 | * | 10/1998 | Bohn et al. | 493/438 |
| 5,970,682 | | 10/1999 | Focke et al. | 53/53 |

FOREIGN PATENT DOCUMENTS

| | | | |
|---|---|---|---|
| 2038959 | 3/1974 | (DE) . | |
| 31 43 826 | 6/1986 | (DE) . | |
| 196 49 543 | 6/1998 | (DE) . | |
| 550406 | 3/1990 | (EP) . | |
| 677444 | 10/1995 | (EP) | B65B/57/02 |
| 885438 | 12/1961 | (GB) . | |
| 2 219 244 | 12/1989 | (GB) . | |

* cited by examiner

*Primary Examiner*—Peter Vo
*Assistant Examiner*—Hemant M. Desai
(74) *Attorney, Agent, or Firm*—Sughrue, Mion, Zinn, Macpeak & Seas, PLLC

(57) ABSTRACT

Process and apparatus for folding or shaping a continuous material web (10) made of thin packaging material. In this case, the material web (10) is directed through a shaping subassembly (27) which uses fixed shaping elements, namely shaping webs (46, 47 and 50, 52) and a mating web (53), to deform the material web (10) during transportation of the same.

13 Claims, 5 Drawing Sheets

14
15
19
41
34
10
21
VI
VII
VII
VI
32
33
27
30
31
28
29
22
V
V
61
IV
IV
44
45
10
26
10
10
III
III
24
25
23
41
40
36
10
12
48
13
38
37
35

Fig.3
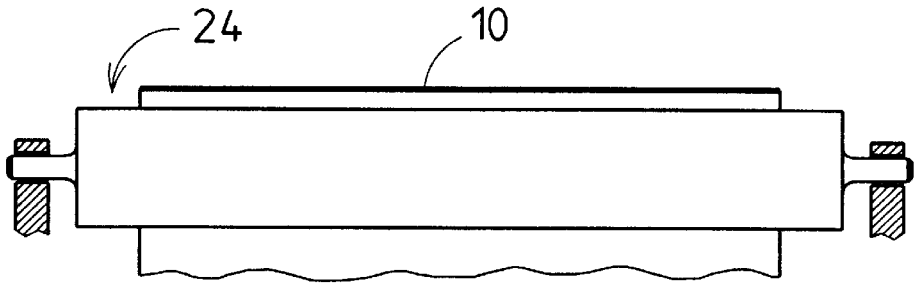
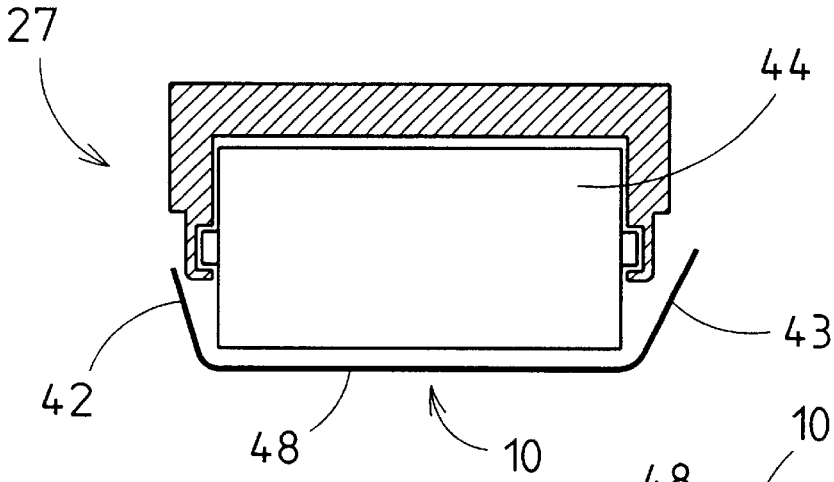
Fig.4
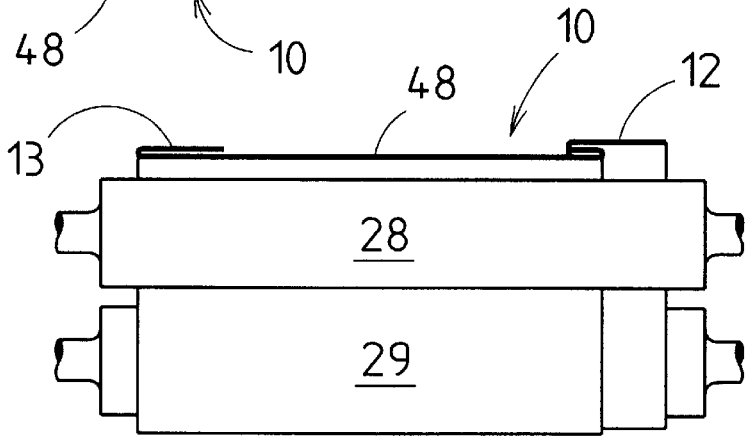
Fig.5
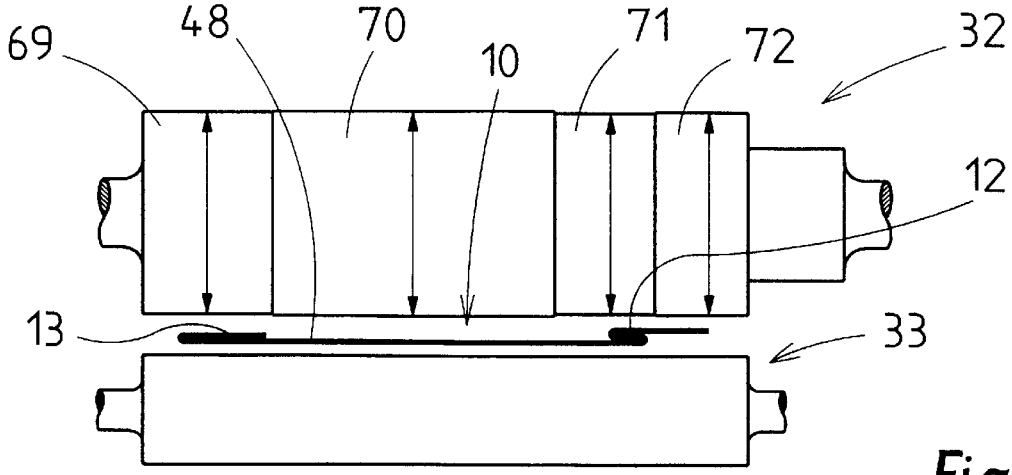
Fig.6

Fig.8
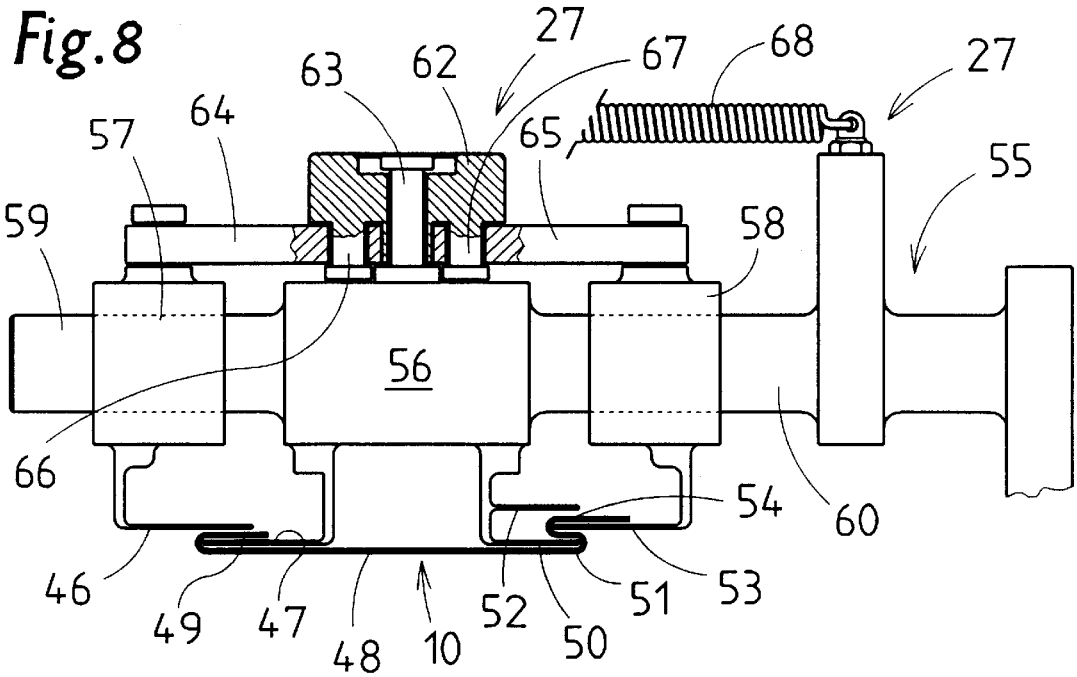
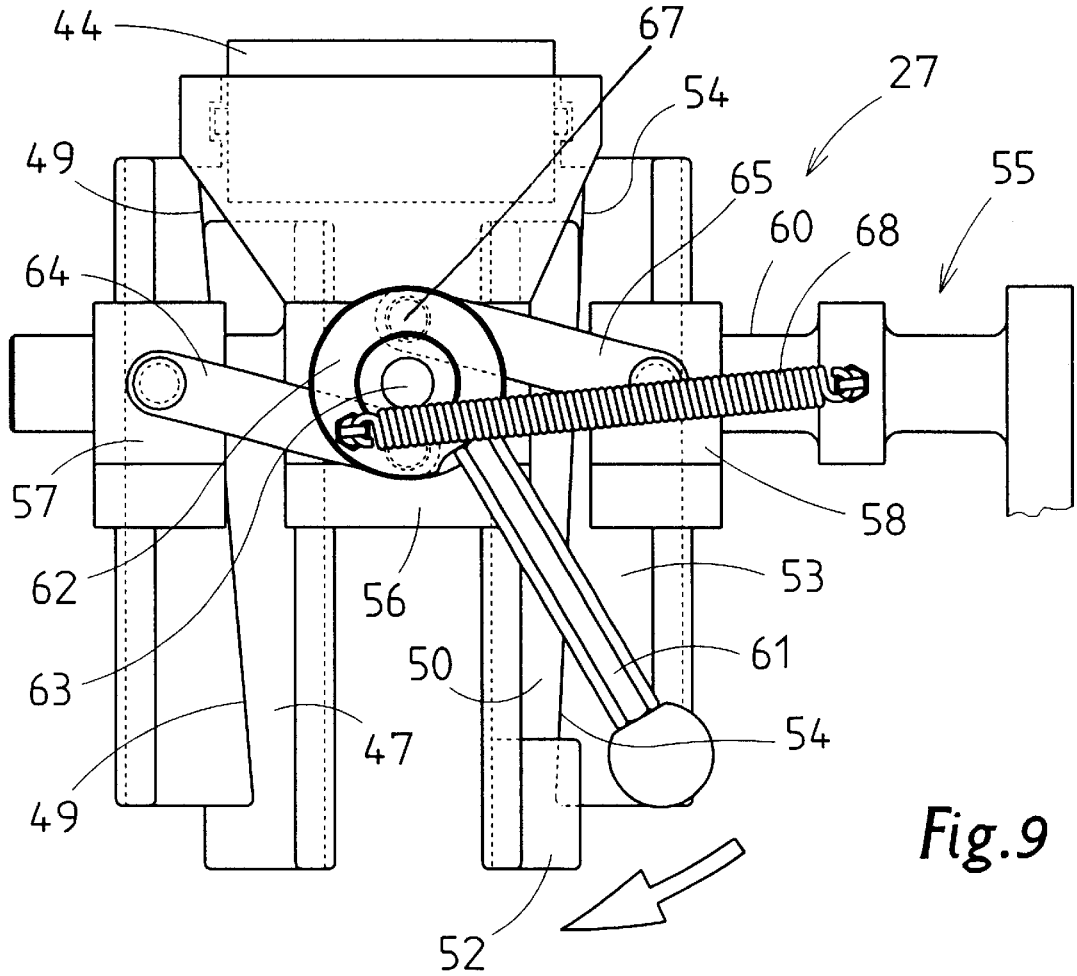
Fig.9

Fig. 10
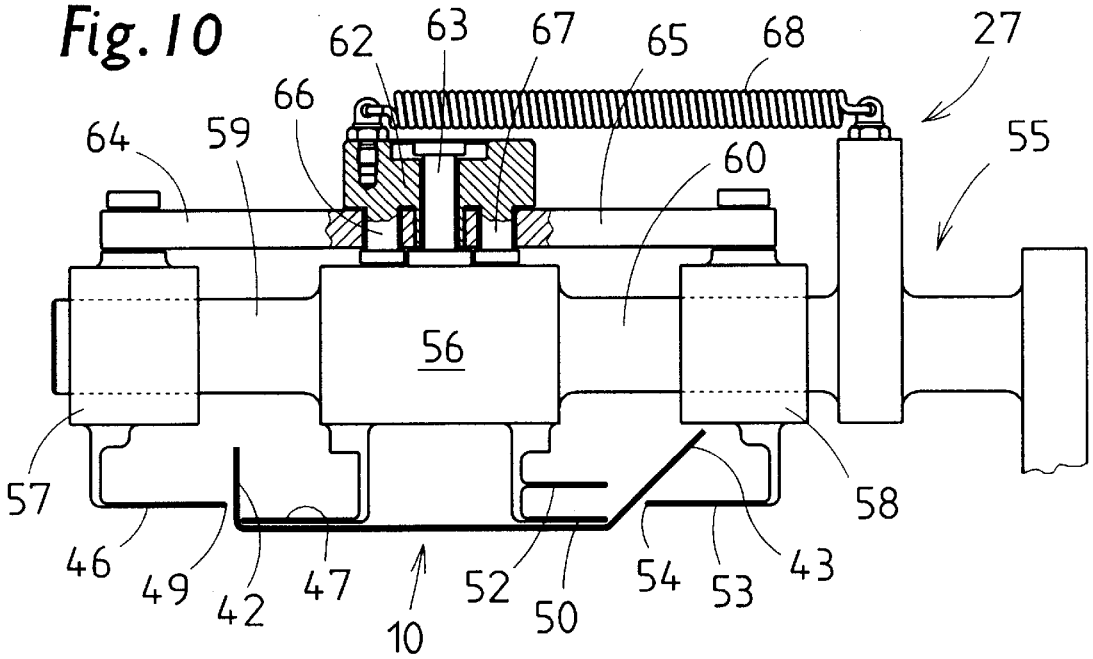
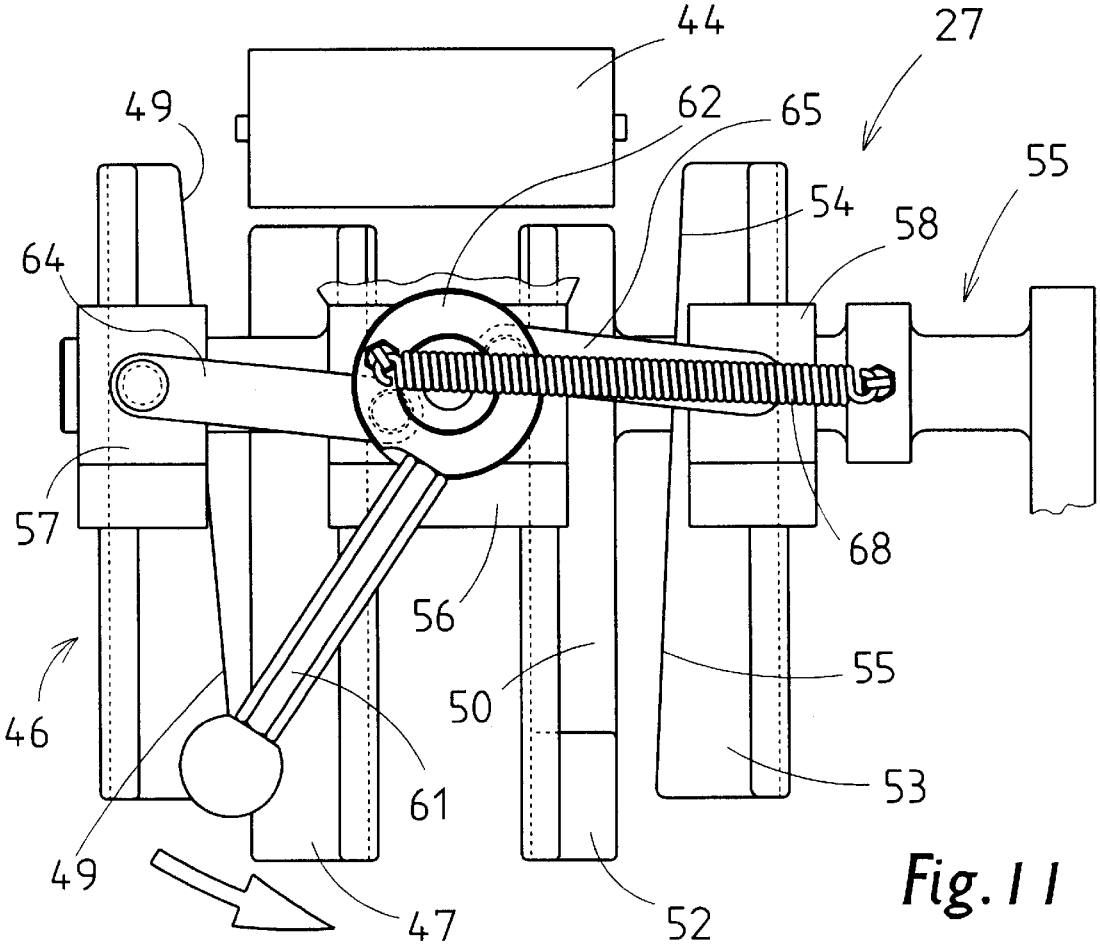
Fig. 11

PROCESS AND APPARATUS FOR PREPARING PACKAGING MATERIAL FOR THE PRODUCTION OF (CIGARETTE) PACKS

BACKGROUND OF THE INVENTION

The invention relates to a process and apparatus for preparing material webs made of packaging material in conjunction with the production of (cigarette) packs, it being the case that the blanks which are severed from the material web have at least one fold, in particular a Z-shaped fold—Z-fold—which extends within the material web, in the longitudinal direction of the same, and/or a border-side, double-layered region formed by virtue of a border strip being folded over.

The invention is concerned with the handling of comparatively thin packaging material such as paper, film or the like, for producing, in particular, cigarette packs of the soft-pack type.

For specifically configured packs of this type, the blank needs to be prepared by having folds provided.

These folds are produced in the region of the continuous material web, with the result that the blanks which are severed from the material web already have the folds. For a prime example, as far as the configuration of the packs is concerned, you are referred to U.S. Pat. No. 5,762,186. In the case of this type of pack, a double-layered fold running all the way round, namely a Z-fold, is provided in the top region, adjacent to an end wall. Furthermore, folding tabs may be formed in a double-layered manner in the region of a base wall, to be precise by a folded-over border strip formed over the length of the blank. These folds are intended to be produced in the region of the material web.

SUMMARY OF THE INVENTION

The object of the invention is to propose measures which ensure that folds are provided effectively in the region of material web in a reliable manner by way of straightforward auxiliary means, to be precise with a high packaging-machine output.

In order to achieve this object according to the invention, the folds are provided in the material web in the region between two retaining positions, in particular between two spaced-apart deflecting rollers, a conveying and shaping section for the material web being formed between said fixed points and, from one fixed point to the other, said material web being transferred gradually from a planar, non-folded position into the folded position.

The invention is based on the finding that the thin-walled packaging material, which can easily be shaped, performs an automatic shaping process along a conveying and shaping section if, at the end of the latter, the folded position is fixed. Most suitable for this purpose are deflecting rollers or roller pairs which have the folded material web guided over their lateral surface for the purpose of stabilizing the folding.

According to a further proposal of the invention, there is installed, in the region of the shaping section of the material web, a shaping subassembly through which the material web is directed. The shaping subassembly has shaping and guide elements which are positioned in a stationary manner and on which the material web is directed, the folding being carried out and/or completed in the process. It is provided that, as far as the entry into the shaping subassembly, the material web is deformed, lateral legs being rendered gradually upright, and the folding continues in the region of the shaping subassembly.

Following the shaping subassembly, the material web is directed over rollers which use pressure to stabilize the folding produced.

The apparatus according to the invention is coupled to a packaging machine, preferably to a packaging machine producing soft packs. The apparatus is arranged such that the material web, for producing the blanks, can be fed to a blank subassembly alternatively with or without folds.

BRIEF DESCRIPTION OF THE DRAWINGS

Further details and features of the process according to the invention and the apparatus are explained in more detail hereinbelow with reference to the drawings, in which:

FIG. 3 shows a detail of the arrangement according to FIG. 2 along a section plane III—III, FIG. 4 shows a further detail of the arrangement according to FIG. 2 along a section plane IV—IV, FIG. 5 shows a detail of the arrangement according to FIG. 2 along a section plane V—V, FIG. 6 shows a further detail of the arrangement according to FIG. 2 along a section plane VI—VI, FIG. 8 shows, on an enlarged scale, a detail of a shaping subassembly for the material web in a transverse view, FIG. 9 shows a plan view of the detail from FIG. 8, FIG. 10 shows an illustration corresponding to FIG. 8 with the position of elements changed, and FIG. 11 shows a plan view of FIG. 10.

The invention is concerned with a continuous material web 10 made of paper, coated paper or thin plastic film being deformed or provided with folds. In the case of the production of cigarette packs 11 of the soft-pack type, the material web 10 consists of (coated) paper.

The material web 10 is provided with longitudinally running folds. These are also present in the blanks, severed from the material web 10, for the production of the cigarette packs 11.

Figures 2, 7:
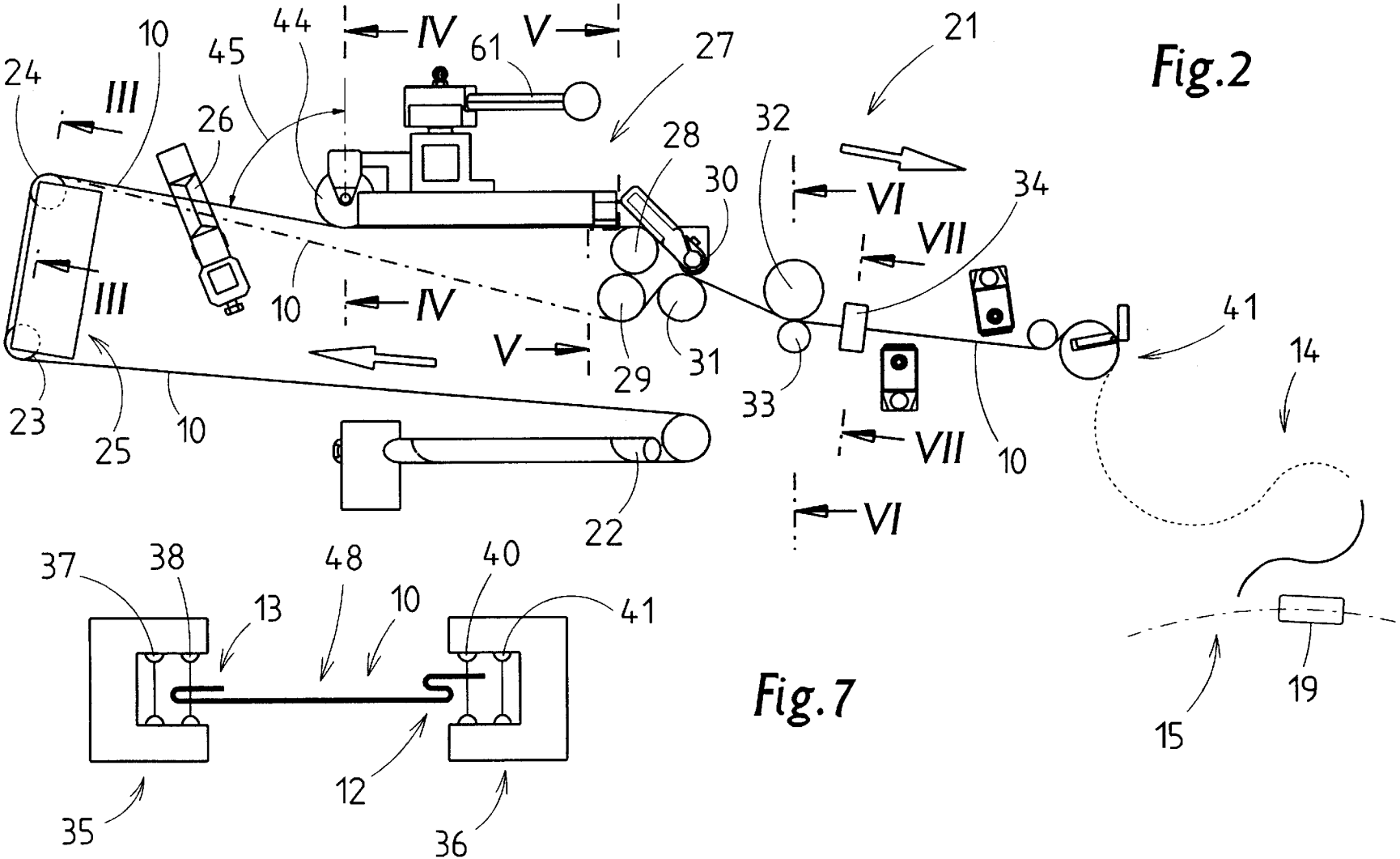
FIG. 2 shows a schematic illustration, in the form of the detail on an enlarged scale, of an arrangement for processing a material web.
FIG. 7 shows a monitoring means for the material web along a section plane VII—VII from FIG. 2.

The soft packs or cigarette packs 11 of the present exemplary embodiment correspond in construction terms to the packs according to U.S. Pat. No. 5,762,186. In the case of this type of pack, a multi-layered fold running all the way round, namely a Z-fold 12, is provided adjacent to an end wall. This fold extends, in the region of the material web 10, at a distance from a free border (FIG. 7). There is also a border-side fold for forming a double-walled folded strip 13. The latter serves for producing double-layered or double-walled folding tabs of base wall of the pack. The folded strip 13 runs on a border region of the material web 10 which is located opposite the Z-fold 12. The folds are each located on the same side of the material web, namely on an inside, which is directed away from a visible surface of the cigarette pack 11. Remaining between these two folds 12, 13 is a planar, non-folded and comparatively wide (central) material strip 48 of the material web 10.

The material web 10, which is prepared in the manner described, is fed to a blank subassembly 14 of a packaging machine (FIG. 1) for the production of cigarette packs 11.

Figure 1:
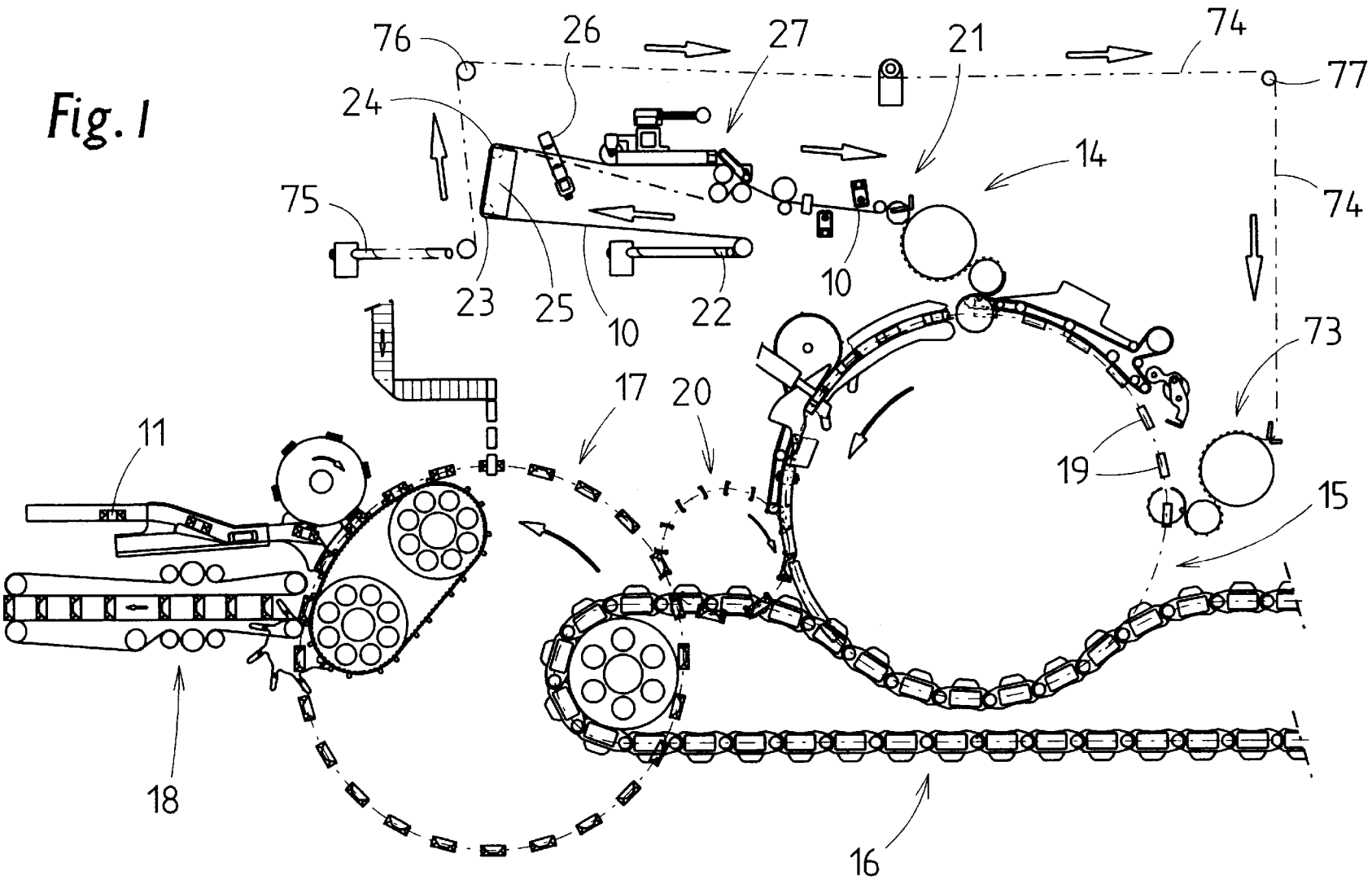
FIG. 1 shows a schematic side view of a region of a packaging machine for soft packs with an arrangement for folding a material web.

This packaging machine, the construction of which is known, is shown schematically in FIG. 1 and comprises a folding turret 15, a pocket chain 16, a drying turret 17 and a removal conveyor 18 for transporting away the finished cigarette packs 11. The pocket chain 16 feeds to the folding turret 15 cigarette groups which correspond to the contents of a cigarette pack 11. With the aid of known folding mandrels 19, the cigarette groups are wrapped in the blank of the material web 10. The finished cigarette packs 10 are passed onto the drying turret 17 by a transfer turret 20 and, finally, are transported away for further packaging via the removal conveyor 18.

A material unit 21 is arranged in the top region or above the folding turret 15. This unit guides the material web 10 to the blank subassembly 14, which severs the blanks and transfers them to the folding turret 15. In the present case, the material web 10 is fed in the lateral direction and is deflected into the conveying plane of the material unit 21 via a deflecting rod 22.

The material web 10 is deflected via two deflecting rollers 23, 24, which are located more or less one above the other, into a more or less horizontal conveying direction to the blank subassembly 14. At the same time, the deflecting rollers 23, 24 are part of an edge control means 25, that is to say a means for aligning the edges of the material web 10 in a correct position. The edge control means 25 interacts with a sensing element 26 for determining the position of the two border edges.

The material web 10 then runs through a shaping subassembly 27, in the region of which the deformation or folding of the material web 10 is carried out and/or completed.

The material web, once its shaping has been completed, is guided over a first deflecting roller 28, following the shaping subassembly 27, and over a further deflecting roller 29. The two deflecting rollers 28, 29 are arranged more or less one above the other. The material web 10 is guided around the deflecting rollers 28, 29 in an essentially S-shaped movement path. Thereafter, the material web runs through a pressing means for stabilizing the folding by means of pressure. Said pressing means comprises two pressing rollers 30, 31. One, top pressing roller 30 is provided on a pressure-exerting means for transferring an adjustable contact pressure to the pressing roller 30.

A pair of drawing rollers 32, 33 follows. The task of these rollers is, by transferring a pulling force, to transport the material web 10, that is to say, in particular, to draw it through the material unit and/or through the shaping subassembly 27. Following the drawing rollers 32, 33, the material web 10 is checked for correct formation by an optoelectronic checking unit 34 (FIG. 7). In the present case, the checking unit 34 comprises two checking elements 35, 36 with U-shaped cross section. Arranged in the region of horizontal legs, above and beneath the material web 10, are optoelectronic sensors 37, 38 and 39, 40, each being designed as a light barrier with a transmitter and receiver located opposite the latter. The sensors 37 . . . 40 check for the correct formation on both sides of the material web 10, the folds being assumed to be present if inner, mutually facing sensors 38, 40 are activated and outer sensors 37, 39 are free.

The material web 10 then passes into the region of the blank subassembly 14. A cutting subassembly 41 severs the blanks from the material web 10. The blanks are fed to the folding turret 15, and transferred to the folding mandrels 19, in a known manner.

The material web 10 is folded or deformed into the cross-sectional configuration according to FIG. 7 in the region of a conveying and shaping section. This conveying and shaping section is defined by two end points, one of which is the deflecting roller 24 and the other of which is the deflecting roller 28. The material web 10 leaves the circumference of the deflecting roller 24 in a planar, non-folded state. Upon reaching the deflecting roller 28, the material web 10 has been shaped or folded.

In a first portion of the conveying and shaping section, namely between the deflecting roller 24 and the entry into the shaping subassembly 27, a first shaping step is carried out during the continuous transportation of the material web 10, to be precise by lateral legs 42, 43 being rendered upright (FIG. 4). The entry side of the shaping subassembly 27 is formed by a guide roller 44, the material web 10 running along the bottom region of the lateral surface of the same. The guide roller 44 is positioned relative to the deflecting roller 24 such that the material web 10 is conveyed in an obliquely downwardly directed plane in this portion of the conveying and shaping section. The material web 10 forms an acute angle 45 of approximately 80° in relation to an (imaginary) vertical plane. This angle is necessary in order that the legs 42, 43, in the conveying region as far as the guide roller 44, can be rendered upright from a planar or horizontal position into the position according to FIG. 4.

The material web 10 which has been preshaped in this manner then runs through the shaping subassembly 27. The shaping or folding is completed therein.

For this purpose, the shaping subassembly 27 has folding and guide elements extending in the conveying direction of the material web 10. These are thin-walled elements which extend in the movement direction of the material web 10 and, on account of their configuration and/or relative positioning, cause the material web 10 to be deformed and folded.

Two shaping webs 46 and 47 are provided for producing the folded strips 13. The material web 10 butts, by way of the (central) material strip 48, against the underside of the bottom, horizontally directed shaping web 47. The other shaping web 46 is arranged above the shaping web 47, to be precise parallel to it and at a small distance from it. The folded-over folded strip 13 runs between the two shaping webs 46, 47. A free, outer border 49 of the bottom shaping web 47 in this case forms the continuous folding and guide edge during the formation of the folded strips 13.

On the opposite side, there is likewise provided, for the purpose of forming the Z-fold 12, a bottom, horizontally directed shaping web 50 with a free, outwardly oriented border 51. Formed at a (relatively large) distance above said shaping web 50 is a second, parallel shaping web 52. A gap, into which a sub-region of the Z-fold 12 enters, is formed between the shaping webs 50 and 52. The Z-shaped fold is formed in conjunction with a mating web 53, which is located approximately centrally between the shaping webs 50, 52 and has a free folding edge 54. The material web 10 is guided in this region such that the Z-fold 12 folds around the border 51 of the shaping web 50 and the folding edge 54 of the mating web 53. The shaping web 52 acts in this case as a holding-down means above the mating web 53.

The shaping webs 46, 47 and 50, 52 and the mating web 53 extend in the conveying direction of the material web 10, their shape and/or dimensions changing along their extent. In the example shown, the (bottom) shaping web 47 is of the same dimension over its entire length. The shaping web 46, which acts as a mating element, is designed in the form of a wedge in plan view (FIG. 9), with the result that the material web 10 or the leg 42, which is assigned to the shaping web 46, is folded over to an increasing extent from the virtually upright position according to FIG. 4 at the beginning of the shaping web 46 into a position according to FIG. 8.

On the opposite side, the mating web 53 is of corresponding design, that is to say it has an increasing width or wedge-shaped configuration and its folding edge 54 extends accordingly. Thus, during the movement of the material web 10, the leg 43 is gradually shaped from the position according to FIG. 4 in the region between the shaping webs 50 and 52, corresponding to FIG. 8. The top shaping web 52 is only required in an end region of the shaping operation and is thus merely designed as a short shaping piece (FIG. 9).

The shaping process described runs continuously between the deflecting roller 24 and the deflecting roller 28, or the outlet from the shaping subassembly 27, with the cooperation of the elements described. At the beginning of an operating process, or for introducing a new material web 10, the shaping elements of the shaping subassembly 27 are arranged such that they can be moved with respect to one another. In the present case, the inner shaping webs 47, on the one hand, and the shaping webs 50 and 52, on the other hand, are provided in a fixed manner on a carrying arm 55, to be precise on the underside of an approximately central carrying body 56. The shaping web 46 and the mating web 53, in contrast, can be displaced transversely to the material web 10, to be precise from the shaping position according to FIGS. 8 and 9 into a lateral starting position according to FIGS. 10 and 11. In this position, the shaping web 46 and the mating web 53 are outside the engagement region of the other shaping webs. The material web 10, which has been preshaped merely in the region of the lateral legs 42, 43, can then be guided (by hand) through the shaping subassembly 27, the legs 42, 43 respectively extending between the shaping webs 46 and 47 and the shaping webs 50 and 52, on the one hand, and the mating web 53, on the other hand. By transverse movement, that is to say in the direction towards one another, the shaping web 46 and mating web 53 then pass into the shaping position according to FIG. 8. The regions of the material web 10 are then deformed correspondingly, that is to say with the formation of the Z-fold 12, on the one hand, and of the folded strip 13, on the other hand. Transportation of the material web 10 can then be started, the adjusted deformation or folding for the material web 10 running through being maintained.

For this purpose, the shaping web 46 and mating web 53 are each arranged on a carrying member 57, 58. These are each mounted displaceably on a sliding member 59, 60 of the carrying body 56.

The described operations for displacing the carrying members 57, 58 and the shaping web 46 and mating web 53, respectively, are carried out manually, to be precise jointly by a hand lever 61. The latter is mounted above the carrying body 56 and connected to a rotary member 62. The latter is mounted rotatably on a journal 63 of the carrying body 56. Levers 64, 65 are connected rotatably to the rotary member 62 on opposite sides. The levers 64, 65, in turn, actuate the shaping web 46 and mating web 53 or the carrying members 57, 58 respectively assigned thereto. By virtue of the rotary member 62 being rotated in one direction or the other (with the aid of the hand lever 61), the levers 64, 65 are adjusted in one direction or the other. This results in the movement of the carrying members 57, 58 between the positions according to FIGS. 8 and 10. For this purpose, the levers 64, 65 are connected, in the region of the rotary member 62, to bearing journals 66, 67 of the rotary member 62.

The two end positions of the shaping web 46 and mating web 53 (FIG. 8, on the one hand, and FIG. 10, on the other hand) are secured by a spring, namely by a tension spring 68. The latter is connected to the rotary member 62 such that the rotary member 62 is always drawn into one of the end positions described.

Alternatively, the apparatus may also be designed such that the other shaping webs 47 and 50, 52 are moved relative to the shaping web 46 and mating web 53, respectively.

Following the outlet from the shaping subassembly 27, the shape of the material web 10 is stabilized by abutment against a large circumferential surface of a roller, namely of the deflecting roller 28. This effect is continued by the further deflecting roller 29. The pressing rollers 30, 31, produce dimensionally stable folding edges in the region of the Z-fold 12 and folded strip 13.

A special feature is the design of the drawing rollers 32, 33 for the advancement of the material web 10. At least one of the drawing rollers 32, 33, in the present case the (top) larger-diameter drawing roller 32, is adapted to the shape of the material web 10 by the formation of step-like roller portions 69, 70, 71, 72 which are offset with respect to one another. The roller portions 69 . . . 72 are configured with different diameters in accordance with the cross section of the material web 10. The central roller portion 70 butts against the (central) material strip 48 and has the largest diameter. The smallest-diameter roller portion 71 is located in the region of the three-layered formation of the material web. Located at the outer end regions in each case are the roller portions 69 and 72 with adapted diameters smaller than the diameter of the roller portion 70. This configuration of the drawing roller 32 means that the material web 10 is conveyed in a precisely rectilinear manner, namely with transmission of tensile force more or less over the entire width.

A further special feature resides in the fact that the packaging machine can also be operated without the material web 10 being deformed in the manner described, that is to say it can be operated with a planar, non-folded material web 10. In this case, the material web 10 is guided, by the deflecting roller 24 of the edge control means 25, past the shaping subassembly 27, to be precise via the deflecting roller 29 and the pressing roller 31, likewise serving as a deflecting roller, directly to the drawing rollers 32, 33. The material web 10 may then likewise be processed in a conventional manner.

Furthermore, it is also possible for the packaging machine to be operated for producing conventional cigarette packs of the soft-carton type, that is to say with an inner blank made of paper or aluminium-laminated paper. In this case, the folding turret 15 is assigned a further blank subassembly 73. The latter is fed a web 74 made of packaging material for the inner wrapper. The said web 74 passes into the region of the folding turret 15 likewise via a deflecting rod 75. Via deflecting rollers 76, 77, the web 74 is conveyed above the material unit 21 and downwards to the blank subassembly 73. It is thus possible to produce packs of different designs with the same packaging machine, merely by way of specific guidance of the packaging material.

List of Designations

10 Material web
11 Cigarette pack
12 Z-fold
13 Folded strip
14 Blank subassembly
15 Folding turret
16 Pocket chain

17 Drying turret
18 Removal conveyor
19 Folding mandrel
20 Transfer turret
21 Material unit
22 Deflecting rod
23 Deflecting roller
24 Deflecting roller
25 Edge control means
26 Sensing element
27 Shaping subassembly
28 Deflecting roller
29 Deflecting roller
30 Pressing roller
31 Pressing roller
32 Drawing roller
33 Drawing roller
34 Checking unit
35 Checking element
36 Checking element
37 Sensor
38 Sensor
39 Sensor
40 Sensor
41 Cutting subassembly
42 Leg
43 Leg
44 Guide roller
45 Angle
46 Shaping web
47 Shaping web
48 (Central) material strip
49 Border
50 Shaping web
51 Border
52 Shaping web
53 Mating web
54 Folding edge
55 Carrying arm
56 Carrying body
57 Carrying member
58 Carrying member
59 Sliding member
60 Sliding member
61 Hand lever
62 Rotary member
63 Journal
64 Lever
65 Lever
66 Bearing journal
67 Bearing journal
68 Tension spring
69 Roller portion
70 Roller portion
71 Roller portion
72 Roller portion
73 Blank subassembly
74 Web
75 Deflecting rod
76 Deflecting roller
77 Deflecting roller

What is claimed is:

1. A process for producing a cigarette pack (11) from at least one thin-walled blank which is to be severed from a continuous, longitudinally extending material web (10) being continuously transported in a direction, the blank having folds (12, 13) running in the longitudinal direction of the material web (10) which form a double-layer border-side folded strip (13) and a continuous Z-fold (12), said process comprising the steps of:

a) making the folds (12, 13) of the material web (10) in a shaping section having a beginning and end formed by first (24) and second (28) deflecting rollers, respectively, for the material web (10);

b) arranging the first deflecting roller (24) to guide by deflection the non-folded or partially folded material web (10) into the shaping section, and arranging the second deflecting roller (28) to guide the material web (10), provided with the folds (12, 13), out of the shaping section;

c) in a first portion of the shaping section following the first deflection roller (24) in the transport direction, shaping the continuously transported material web (10) into an intermediate folded position forming lateral, upwardly directed legs (42, 43) of the web; and d) guiding the lateral, upwardly directed legs (42, 43) of the material web (10) through a shaping subassembly (27) in which the upwardly directed legs (42, 43) form the border-side folded strip (13) and the Z-fold (12) by means of stationary folding elements (46, 47; 50, 52, 53).

2. The process according to claim 1, further comprising the steps of:

in a first portion of the shaping section following the deflecting roller (24) in the transport direction, transporting the material web (10) downwards at an acute angle, with respect to an imaginary vertical plane, to a first folding member for the formation of the upwardly directed legs (42, 43); and in a portion following said first portion of the shaping section, conveying the material web (10) in a substantially horizontal plane.

3. An apparatus for producing a cigarette pack (11) of the soft-pack type from at least one thin-walled blank which is to be severed from a continuous, longitudinally extending material web (10) being continuously transported in a direction, the blank having folds (12, 13) which run in the longitudinal direction of the material web (10) and which form a double-layer border-side folded strip (13) and a continuous Z-fold (12), said apparatus comprising:

a) means for continuously conveying the material web (10) through a shaping section which has a beginning and an end which are respectively defined by first (24) and second (28) deflecting rollers for the material web (10);

b) means for transporting the material web in the shaping section (10) past a first shaping element (44) for producing lateral, upwardly directed legs (42, 43) of the material web (10); and c) a shaping subassembly (27), d) the material web (10) with said upwardly directed legs (42, 43) being transported through said shaping subassembly (27) which applies the folds (12, 13) to the material web (10) in regions of the legs (42, 43), respectively, e) wherein said shaping subassembly (27) has stationary folding elements comprising:

first (46) and second (47) shaping webs spaced one above the other for making the folding strip (13); and third (50) and fourth (52) stationary shaping webs spaced one above the other, and a mating web (53) which extends into a region between the third and fourth shaping webs (50, 52), for making the Z-fold (12).

4. The apparatus according to claim 3, further comprising a guide roller (44), wherein the material web (10), following said first deflecting roller (24) in the transport direction, is conveyed downwards, at an acute angle with respect to an imaginary vertical plane to said guide roller (44), in an entry region of said shaping subassembly (27), so that the legs (42, 43) of the material web (10) are rendered upright by said guide roller (44).

5. The apparatus according to claim 3, wherein:

a) said folding elements for folding the material web (10) in the shaping subassembly (27) comprise horizontal, thin-walled webs;

b) the material web (10) lies on a bottom side of the second shaping web (47) adjacent to the folding strip (13) to be made; and c) the first shaping web (46) is positioned at a short distance above the second shaping web (47) in such a way that, during the transport of the material web (10), the folding strip (13) is folded between the first and second shaping webs by lying against an upper side of the lower second shaping web (47).

6. The apparatus according to claim 3, wherein:

a) the third and fourth shaping webs (50, 52) are horizontal;

b) a region of the material web (10) adjacent to one (43) of the upwardly directed legs abuts a bottom side of the third shaping web (50);

c) said mating web (53) is positioned between shaping webs (50, 52) at half the height between the lower third shaping web (50) and the upper fourth shaping web (52); and d) said one upwardly directed leg (43) is folded in the Z-shape by the third and fourth shaping webs (50, 52) and the mating web (53), said one upwardly directed leg (43) being folded around a folding edge (54) of the mating web (53) to form an angle.

7. The apparatus according to claim 3, wherein individual ones of said folding elements, namely the first shaping web (46) and the mating web (53), are movable, relative to other ones of said folding elements, namely the second shaping web (47) and the third and fourth shaping webs (50, 52) respectively, transversely to the longitudinally extending material web (10) such that in a retracted, starting position, the non-folded material web (10) is introduced into the shaping subassembly (27), and such that, by virtue of the movement of the first shaping web (46) and the mating web (53) into a shaping position, the material web (10) is folded.

8. The apparatus according to claim 6, wherein, as seen in the transport direction of the material web (10), the thin-walled shaping and mating webs gradually increase in width such that the legs (42, 43) move into folded positions to an increasing extent by the gradually changing shape of the first shaping web (46) and of the mating web (53), said legs sliding along borders (49, 51) of the shaping webs and along a folding edge (54) of the mating web.

9. The apparatus according to claim 3, wherein the second deflecting roller (28) is arranged at an outlet end of the shaping section, said apparatus further comprising pressing rollers (30, 31) for pressing the material web (10) onto the second deflecting roller (28) in a region of the folds (12, 13).

10. The apparatus according to claim 9, further comprising drawing rollers (32, 33), following the pressing rollers (30, 31) in the transport direction the web, for transporting the web, at least one of said drawing rollers being adapted to a cross-sectional shape of the folded material web (10) and having roller portions (69, 70, 71, 72) of different diameters.

11. The apparatus according to claim 3, further comprising, following the shaping subassembly (27) in the transport direction, a checking unit (34) for checking and monitoring the folds which have been made in said shaping assembly (27).

12. The apparatus according to claim 9, further comprising means for deflecting one (31) of said pressing rollers to direct the material web past the shaping subassembly (27), in order to avoid folding of the material web (10).

13. The apparatus according to claim 7, wherein, as seen in the transport direction of the material web (10), the thin-walled shaping webs and mating gradually increase in width such that the legs (42, 43) move into folded positions to an increasing extent by the gradually changing shape of the first shaping web (46) and of the mating web (53), said legs sliding along borders (49, 51) of the shaping webs and along a folding edge (54) of the mating web.

* * * * *